United States Patent [19]

Carr, Jr.

[11] 4,057,202

[45] Nov. 8, 1977

[54] WINCH CABLE ROLLER ASSEMBLY

[75] Inventor: Harold F. Carr, Jr., Hixson, Tenn.

[73] Assignee: Ernest Holmes Division, Dover Corporation, Chattanooga, Tenn.

[21] Appl. No.: 719,900

[22] Filed: Sept. 2, 1976

[51] Int. Cl.[2] ..... B65H 57/00

[52] U.S. Cl. ..... 242/157 R; 242/157.1; 242/158 R

[58] Field of Search ..... 242/157 R, 157.1, 158 R, 242/158.2

[56] References Cited

U.S. PATENT DOCUMENTS

| | | | |
|---|---|---|---|
| 3,589,643 | 6/1971 | Takizawa | 242/158.2 |

FOREIGN PATENT DOCUMENTS

| | | | |
|---|---|---|---|
| 239,809 | 7/1962 | Australia | 242/157.1 |
| 1,185,448 | 1/1965 | Germany | 242/157 R |

*Primary Examiner*—Stanley N. Gilreath

[57] ABSTRACT

A cable engaging apparatus is disclosed for a drum having cable spooled thereon, which forces the cable as it is wound onto the spool, into axially adjacent positions with respect to preceding portions of the cable on the drum. The apparatus comprises a roller means having a plurality of resilient discs mounted coaxially thereon. The roller is mounted with its axis approximately parallel to the axis of the drum. The circumferential surfaces of the discs are placed in resilient engagement with the cable spooled on the drum, applying an axially directed guide force to the cable as it is wound onto the drum.

12 Claims, 5 Drawing Figures

FIG. 1a
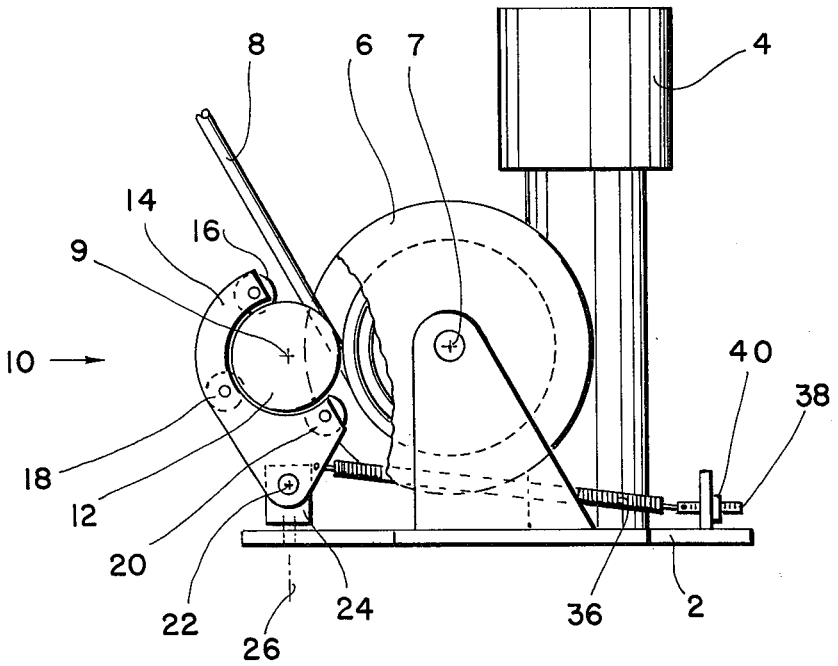
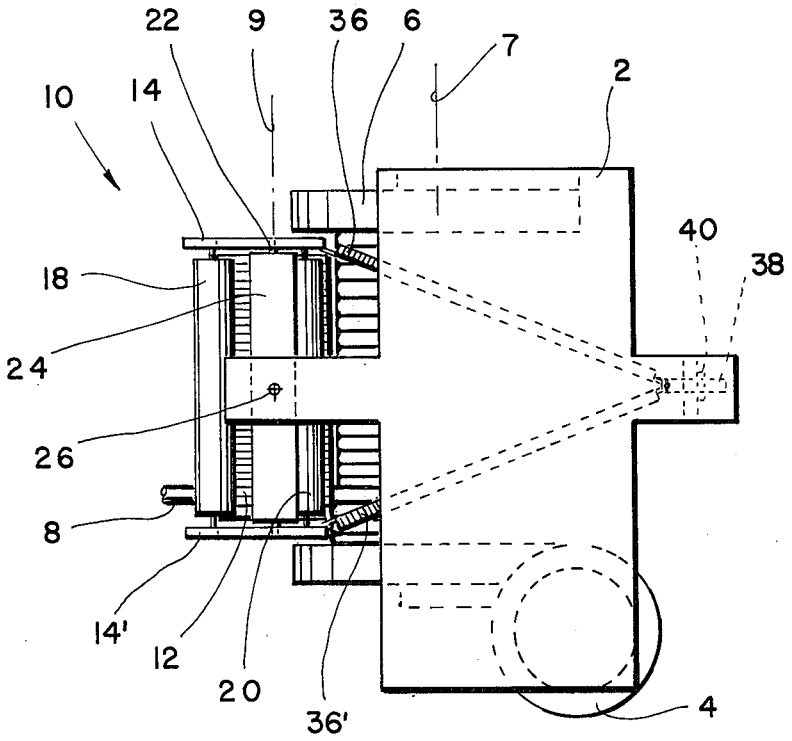
FIG. 1b

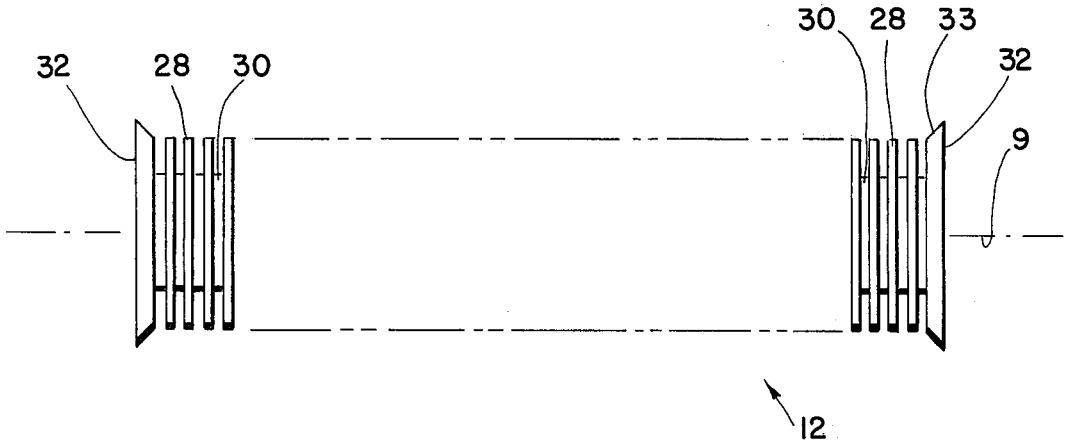
FIG. 3
FIG. 4
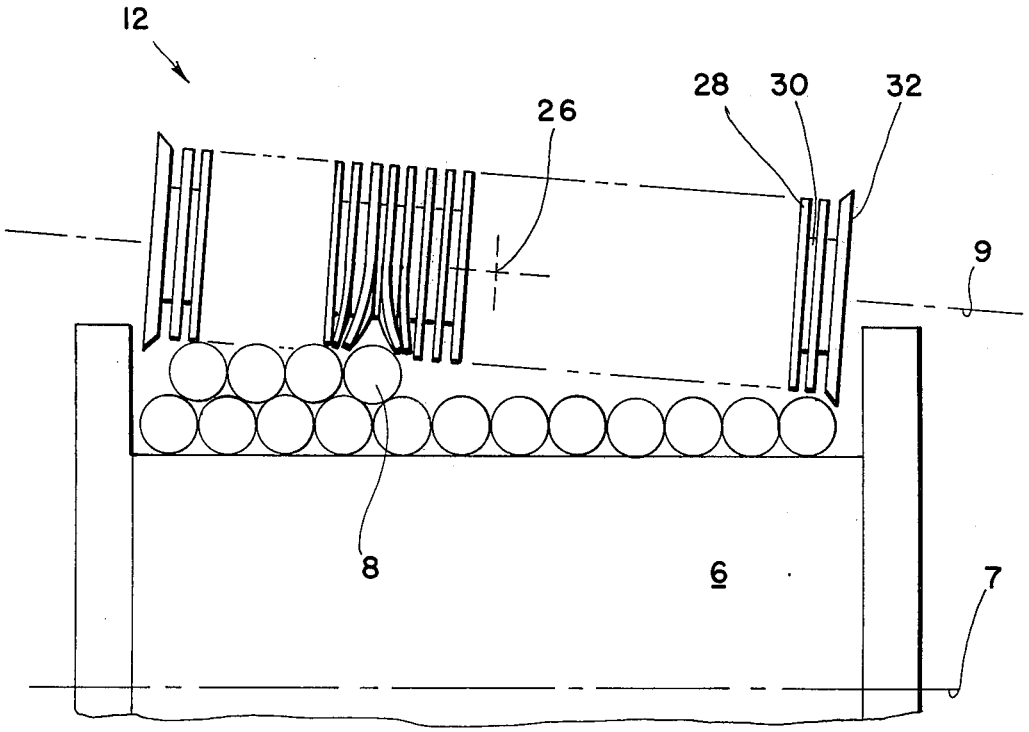

WINCH CABLE ROLLER ASSEMBLY

FIELD OF THE INVENTION

The invention disclosed relates to the cable winding apparatus and more particularly relates to apparatus for uniformly winding a cable onto a drum.

BACKGROUND OF THE INVENTION

Conventional cable winding apparatus consists of an engine driving a cable drum, about which is wound cable, thereby applying a tension force to the cable. In order to prevent damage to the cable, it is necessary for the cable to be uniformly wound about the drum, with no kinks, tangles or cross-overs. In addition, a greater quantity of cable can be wound about a drum of a given size if the cable has been wound uniformly.

Prior art attempts to uniformly guide the cable wound upon a cable drum have met with various deficiencies on certain types of equipment. One prior art technique employs a solid roller which is forced against the cable as it is wound upon the drum. Experience has shown that this approach has not been reliable for producing uniformly wound patterns for cable wound in multiple layers on the drum in particular applications where loads vary and cable fleet angles are greater than normal. Another prior art technique for uniformly winding a cable onto a drum has employed a non-rotating member such as a spring or a resilient web which applies a small, axially directed force on the cable to force it against the last wound portion of the cable on the drum during the winding operation. These prior art approaches uniformly suffer from the problem of imparting great frictional forces between the spring or web member and the cable, reducing the efficiency of operation of the winch mechanism and increasing the wear and tear on the cable itself. Clearly what the prior art requires is an apparatus which can uniformly wind a cable onto a drum without imparting large frictional forces.

OBJECTS OF THE INVENTION

It is therefore an object of the invention to uniformly wind the cable onto a drum in an improved manner.

It is another object of the invention to uniformly wind the cable onto a drum with a reduced frictional force.

It is still another object of the invention to uniformly wind the cable onto a drum with a reduced wear and tear on the cable.

SUMMARY OF THE INVENTION

These and other objects, features and advantages of the invention will be accomplished by the winch cable roller assembly disclosed herein. The winch cable roller assembly has a roller means mounted adjacent to a drum having a cable spooled thereon. The roller means is comprised of a plurality of resilient discs mounted coaxially. The roller is mounted with its axis approximately parallel to the axis of the drum and with the circumferential surface of the discs in resilient engagement with the cable spooled on the drum. The resilient discs apply an axially directed guide force to the cable as it is wound onto the drum. In this manner, as each wrap of the cable is spooled onto the drum, it is forced into an axially adjacent position with the preceding wrap. There is no necessity for a precut helical groove in the drum surface since the winch cable roller assembly automatically insures that a helical pattern will be formed by the cable as it is wound onto the drum. No excessive frictional forces are applied to the cable and therefore the efficiency of the winch apparatus is not impaired and there is no additional wear and tear on the cable itself.

DESCRIPTION OF THE FIGURES

These and other objects, features and advantages of the invention will be more particularly appreciated with reference to the accompanying drawings.

FIG. 1*a* is a side view of a winch apparatus showing the relative position of the winch cable roller assembly.

FIG. 1*b* is a bottom view of the apparatus shown in FIG. 1*a*.

FIG. 3 is a detailed view of the roller portion of the winch cable roller assembly, showing the resilient discs.

FIG. 4 is an illustration of the roller of FIG. 3, with the resilient discs operatively engaging the cable being wound on a drum.

DESCRIPTION OF THE PREFERRED EMBODIMENT

Figure 2:
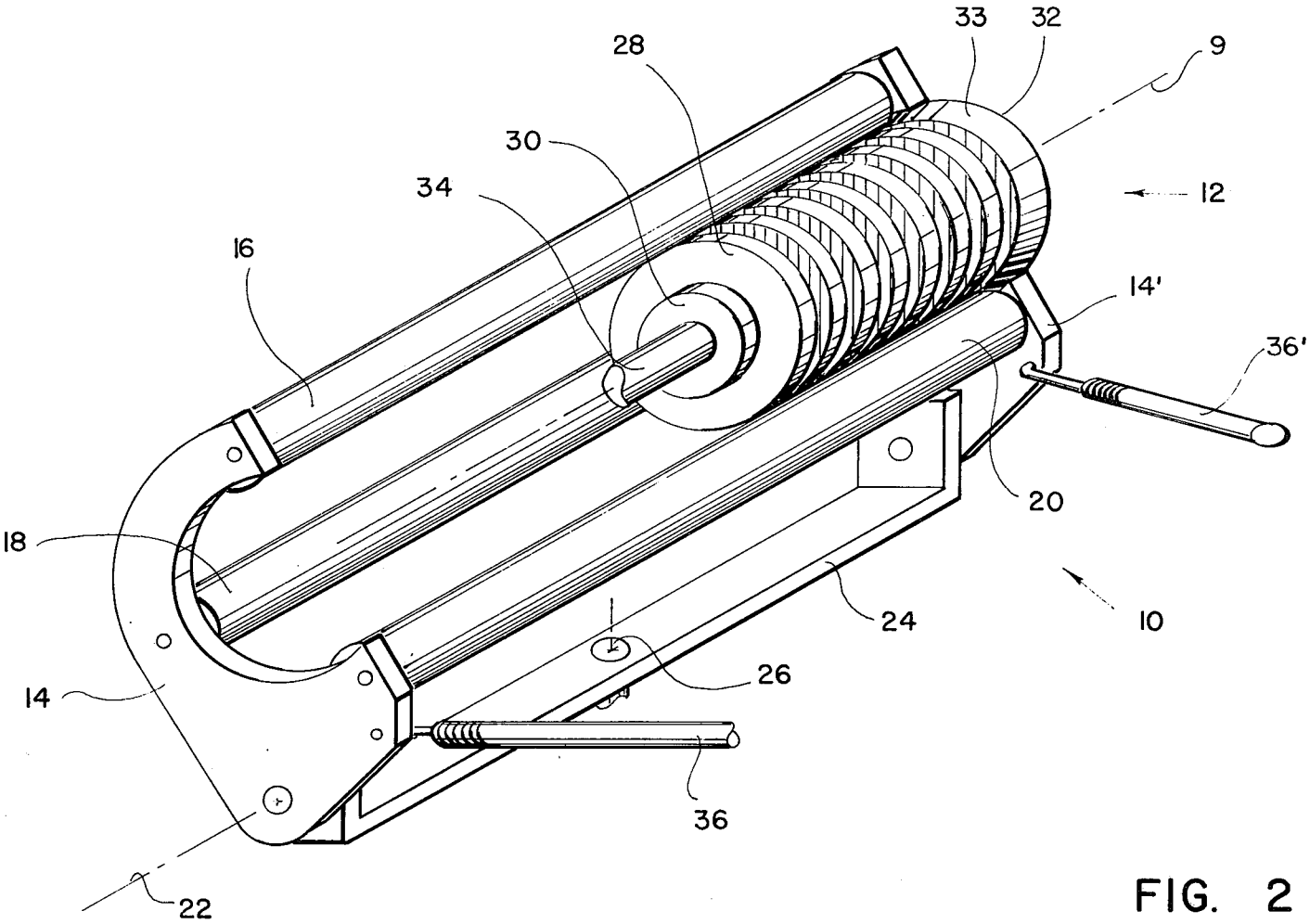
FIG. 2 is a detailed side view of the winch cable roller assembly.

A typical winch system within which the winch cable roller assembly invention finds application is shown in a side view in FIG. 1*a* and a bottom view in FIG. 1*b*. The chasis 2 supports the motor 4 which drives the cable drum 6 which rotates about the axis 7 winding the cable 8. The winch cable roller assembly 10 is shown pivotally mounted about the pivot axis 22 in proximity to the cable 8 wound on the drum 6.

A more detailed illustration of the winch cable roller assembly is shown in FIG. 2 where it is seen to comprise the end members 14 and 14' upon which are mounted the support rollers 16,18 and 20. Nested within the cage-like arrangement of the support rollers 16, 18 and 20 is the roller means 12 which rotates about the axis 9 and whose surface contacts the surface of the cable being wrapped about the drum 6. The end members 14 and 14' pivot about the pivot axis 22 and are toward the drum 6 by means of the springs 36 and 36'. The end members 14 and 14' are pivotally mounted on the U-shaped pivot mounting member 24 which, in turn, is pivotally mounted on the chasis 2, about an axis 26 substantially perpendicular to the axis 7 of the drum 6.

The roller means 12 which is supported by the support rollers 16, 18 and 20, is shown to better advantage in FIG. 3, where it is seen that the roller is comprised of a plurality of resilient discs 28 which are mounted coaxially about the axis 9 and spaced by the spacers 30. The resilient discs 28 are composed of a material such as synthetic rubber or plastic. The discs 28 and spacers 30 are annular in shape and are mounted on the circumference of the shaft 34. The outer diameter of the discs 28 is larger than the outer diameter of the spacers 30 so as to enhance the axial grasping effect of the discs 28 as they engage the cable 8 as it is wound on the drum.

The roller means 12, in addition, has beveled end caps 32 having a beveled surface 33, which are mounted at opposite ends of the roller means 12. As the cable is wound upon the drum and reaches one axial end thereof, it will contact the beveled surface 33 of the beveled end cap 32 which thereby imparts an axial force on the cable reversing the axial direction of the wrapping for the cable as the wrapping of a layer of the cable is completed on the drum. The material of which the beveled end cap 32 is composed may be the same as the material of which the discs 28 are composed.

Although the preferred embodiment for the roller 12 is that of a plurality of annular spacers and annular resilient discs mounted alternately and coaxially on a shaft, other structures for the roller means 12 are suitable. For example, the roller means 12 may be a cylindrical casting of a resilient material, having a serrated surface forming a space sequence of coaxial discs. Alternately the roller means 12 may be a cylindrical shaft of resilient material having an axially spaced array of circular slots machined in its circumference forming a spaced sequence of coaxial discs.

FIG. 4 illustrates the operation of the roller means 12 as cable 8 is wound upon the drum 6, showing in particular the grasping function of the resilient discs 28 as they resiliently engage the cable 8 as it is wound upon the drum, imparting an axially directed force on each wrap of the cable as it is wound on the drum, forcing it into an axially adjacent position with the preceding wrap. The pivot mounting member 24, being pivotally mounted about the axis 26 substantially perpendicular to the axis 7 of the drum 6, enables the roller means 12 to pivot about the axis 26 to enable the roller's resilient discs 28 to further conform to the contour of the cable 8 being spooled on the drum 6, as is shown in FIG. 4. The springs 36 and 36' are connected to one end of a threaded shaft 38 which has its other end threaded through the nut 40 anchored to the chasis 2. In this manner, the tension on the springs 36 and 36' may be adjusted to adjust the force with which the roller means 12 contacts the cable 8 spooled on drum 6.

The resulting winch cable roller assembly allows cable to be more uniformly wound upon the cable drum without the necessity of having precut helical grooves in the drum or unnecessarily imparting frictional forces to the cable.

Although a preferred embodiment of the invention has been disclosed changes may be made in the combination and arrangement of parts as hereto set forth in the specification and shown in the drawings, without departing from the spirit and the scope of the invention.

I claim:

1. A cable engaging apparatus for a drum having cable spooled thereon, comprising:

a roller means comprised of a pluality of resilient discs mounted coaxially;

means for mounting said roller means with its axis approximately parallel to the axis of said drum; and forcing means connected to said mounting means for urging the circumferential surface of said discs towards the drum and into resilient engagement with said cable spooled on said drum, said discs thereby applying an axially directed guide force thereto;

whereby as each wrap of said cable is spooled on said drum, it is forced into an axially adjacent position with the preceding wrap.

2. The apparatus of claim 1, wherein said means for mounting further comprises:

first and second end members pivotally mounted about an axis approximately parallel to the axis of said drum;

a plurality of support rollers, each having a first end rotatably mounted on said first end member and a second end rotatably mounted on said second end member;

said forcing means being connected to said first and second end members, for urging said end members to rotate about said pivotal mounting and urging said support rollers toward said drum;

said support rollers contacting the circumference of said roller means and urging it into engagement with said cable spooled on said drum.

3. The apparatus of claim 2, which further comprises:

a pivot mounting member pivotally mounted about an axis substantially perpendicular to the axis of said drum, with a first end serving as the pivot mounting for said first end member and a second end serving as the pivot mounting for said second end member;

whereby said roller means can pivot about said substantially perpendicular axis, to enable said roller's resilient discs to further conform to the configuration of said cable spooled on said drum.

4. The apparatus of claim 1, wherein said roller means if further comprised of:

first and second beveled end caps mounted at opposite ends of said roller means, for reversing the axial direction of wrapping for said cable as the wrapping of a layer of cable is completed on said drum.

5. The apparatus of claim 1, wherein said roller means is further comprised of:

a shaft;

a plurality of annular spacers mounted coaxially on said shaft, having a first outer diameter;

said plurality of resilient discs being mounted coaxially on said shaft, mutually spaced by one of said spacers, having an outer diameter greater than said first diameter.

6. The apparatus of claim 1, wherein said roller means further comprises:

a cylindrical casting of a resilient material, having a serrated surface forming a spaced sequence of coaxial discs.

7. The apparatus of claim 1, wherein said roller means further comprises:

a cylindrical shaft of resilient material having an axially spaced array of circular slots machined in its circumference forming a spaced sequence of coaxial discs.

8. The apparatus of claim 1, wherein said roller means is composed of a material selected from the group consisting of synthetic rubber and plastic.

9. The apparatus of claim 2, wherein each of said first and second end members further comprises:

a C-shaped member having a substantially semi-circular shape with a bottom portion pivotally mounted about said axis approximately parallel with the axis of said drum, having a side portion, a top portion and an open portion opposed to the said portion;

said end member having a first one of said support rollers mounted on said bottom portion, a second one of said support rollers mounted on said side portion and a third one of said support rollers mounted on said top portion;

said plurality of support rollers and said first and second end members forming a cage about said roller means with an open space corresponding to said open portion of said end member, to permit contact between said roller means and said spooled cable.

10. The apparatus of claim 9, wherein said forcing means further comprises:

a first spring connected to said first end member;

a second spring connected to said second end member;

a tension adjusting means connected to said first and second springs, for adjusting the force with which said roller means contacts said cable spooled on said drum.

11. The apparatus of claim 10, wherein said tension adjusting means is a threaded shaft with one end connected to said first and second springs and the other end threaded into an anchored nut.

12. The apparatus of claim 3, wherein said pivot mounting member further compromises:

a U-shaped member having a bottom portion and a first and second opposed side portions, the bottom portion being pivotally mounted about said axis substantially perpendicular to the axis of said drum and the side portions serving as pivotal mounting points for said first and second end members, having pivotal axes substantially perpendicular to said pivotal axis for said bottom portion.

* * * * *